United States Patent [19]

Meinunger

[11] 4,368,741

[45] Jan. 18, 1983

[54] DEVICE FOR ROLLING OF CIGARETTES

[75] Inventor: Helmut Meinunger, Radevormwald, Fed. Rep. of Germany

[73] Assignee: Gizeh-Werk GmbH, Bergneustadt, Fed. Rep. of Germany

[21] Appl. No.: 139,330

[22] Filed: Apr. 11, 1980

[30] Foreign Application Priority Data

Apr. 12, 1979 [DE] Fed. Rep. of Germany ..... 2915042

[51] Int. Cl.[3] ..... A24C 5/40; A24C 5/42; A24C 5/44

[52] U.S. Cl. ..... 131/55; 131/54; 131/56; 131/57; 131/58

[58] Field of Search ..... 131/54, 47, 50, 51, 131/52, 53, 54, 55–57, 58

[56] References Cited

U.S. PATENT DOCUMENTS

| | | | |
|---|---|---|---|
| 536,630 | 4/1895 | Jerstrum | 131/55 |
| 859,908 | 7/1907 | Barrett | 131/54 |
| 1,879,266 | 9/1932 | Hunter | 131/55 |
| 1,901,259 | 3/1933 | Portteus | 131/55 |
| 1,924,643 | 8/1933 | Gay | 131/54 |

*Primary Examiner*—V. Millin
*Attorney, Agent, or Firm*—James C. Wray

[57] ABSTRACT

Device for rolling of cigarettes with a flat basic structure open on the top, in which there is disposed a belt moving around a cylinder, characterized in that the cylinder is rotatably arranged in a slidable member alongside an upper edge of the basic structure, and that transverse to the direction of movement, under the belt, there is a recess which at its upper edge, terminates into flat tables.

6 Claims, 7 Drawing Figures

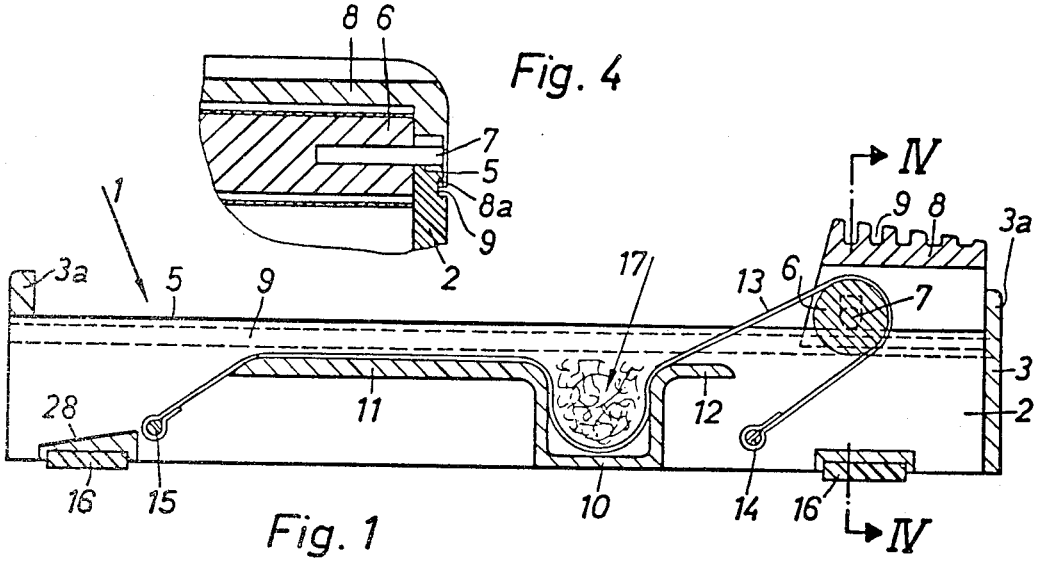
Fig. 4
Fig. 1
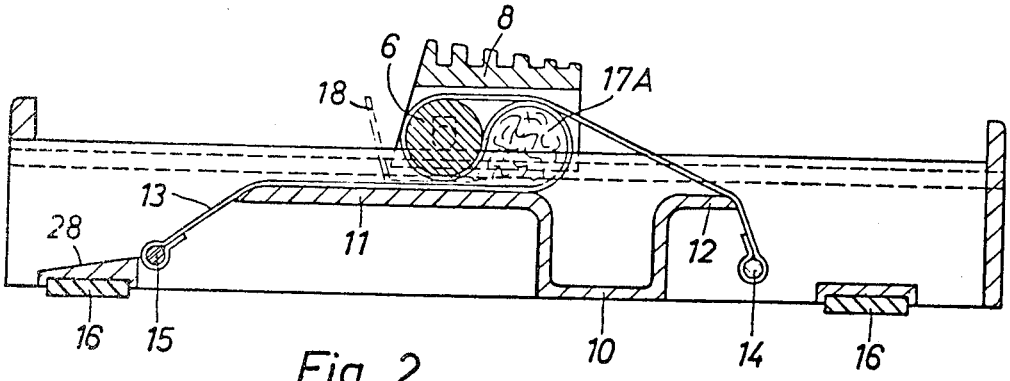
Fig. 2
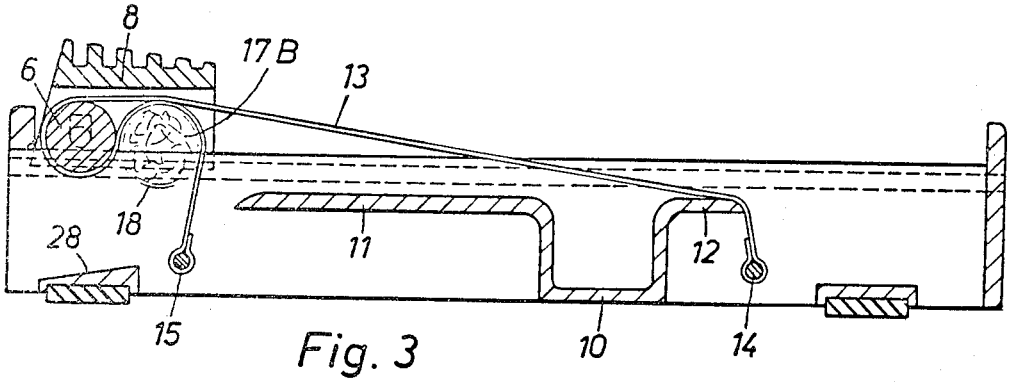
Fig. 3

DEVICE FOR ROLLING OF CIGARETTES

BACKGROUND OF THE INVENTION

The invention relates to a device for rolling cigarettes, having a flat basic structure, open on the top, in which there is fastened a belt, moving around a cylinder.

In a conventional device of this kind (German PS No. 7 021), the belt is located in a hinged lid of the main body. Operation of this device is cumbersome, and the cigarettes thus made do not meet today's high standards expected for home-rolled cigarettes.

The invention provides a simple table device for rolling of cigarettes, producing cigarettes of a high quality. In accordance with the invention, this is achieved in that the cylinder is rotatably arranged in a slidable member alongside the upper edge of the main body, and that transverse to the sliding direction, under the belt, there is a recess terminating at its upper edge into a flat plate. Advantageously, the slidable member is movably mounted by a tongue in a groove in the side wall of the main body. This inventive device permits the manufacture of high-quality cigarettes in a simple manner.

According to a further refinement of the invention, it is possible to obtain cigarettes of different diameters. This is achieved in that the belt can be wound onto a shaft located in the basic structure. The shaft can be locked at a certain angle by way of an adjusting device. By winding the belt onto the shaft, it is shortened, and the diameter of the cigarette to be rolled is reduced.

When rolling cigarettes of small diameter, it is possible to use too much tobacco, and upon rolling it becomes so tightly compressed that the cigarette produced has little or no draw. In order to avoid this problem, a still further refinement of the invention provides that the fastening of the belt is slidable against the force of a spring. This can be effected in such a way that a securing pin for the belt is held by a rod in the basic structure which is horizontally slidable against a spring force. Therefore, if the pull of the belt is extensive or if too large an amount of tobacco has been inserted, the belt securing pin is displaced against the force of the spring extending the belt, so that although a somewhat thicker cigarette is produced, it does, however, have the desired draw.

BRIEF DESCRIPTION OF THE DRAWINGS

The examples in the drawings show additional features of the invention as follows:

FIG. 1 - a longitudinal section of the device in which the slidable member is in its initial position FIG. 2 - a section according to FIG. 1, in which the slidable member is in the center position FIG. 3 - a section according to FIG. 1 in which the slidable member in the end position FIG. 4 - a section along the line IV—IV in FIG. 1.

DETAILED DESCRIPTION OF THE DRAWINGS

Figure 6:
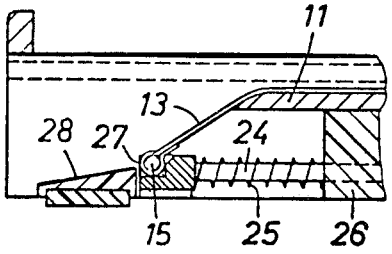
FIG. 6 - a partial section according to FIG. 5

This cigarette rolling device has flat, block-shaped basic structure 1 which is open on the top. The two end areas 3 of basic structure 1 extend over its upper edge and form stops 3*a*. Basic structure 1 on upper edge 5 of side walls 2 has a cylinder 6, preferably made of synthetic material, rotatably stored via pivots 7 in slidable member 8, having surface ribbing 9. Slidable member 8 meshes with groove 9 in side wall 2 of structure 1 via tongue 8*a*, which has a recessed area.

Inside basic structure 1 there is a recess 10 extending parallel to the axis of cylinder 6, whose upper edge on one side (left, in the drawing), extends into a longer table 11, and on the other side into a shorter table 12. A belt 13 is fastened to a pin 14 on one side of basic structure 1, is led around cylinder 6 and fastened with its other end to pin 15, located in basic structure 1.

In the bottom of basic structure 1, resilient strips 16, running parallel to pins 14 and 15, ensure good support of basic structure 1, preventing it from sliding.

To activate the inventive device, slidable member 8 is first brought into proper position depicted in FIG. 1 and belt 13 is pressed into recess 10. Then cavity 17 thus formed is filled with tobacco and slidable member 8 is moved initially into the position depicted in FIG. 2. This causes cavity 17 to become cylinder 17A, essentially closed. No cigarette paper 18, shown by dash-dotted line FIG. 2, is placed in front of slidable member 8 onto that part of belt 13 resting on table 11 and is moistened after a short further movement of slidable member 8.

Thereafter, slidable member 8 is brought into the position depicted in FIG. 3. In this way, the cigarette at the end of table 11 drops into basic structure 1 and rolls on slanted area 28 out of the basic structure 1. The finished cigarette has the cylindrical form 17B which is indicated by dash-dotted line.

Figure 7:
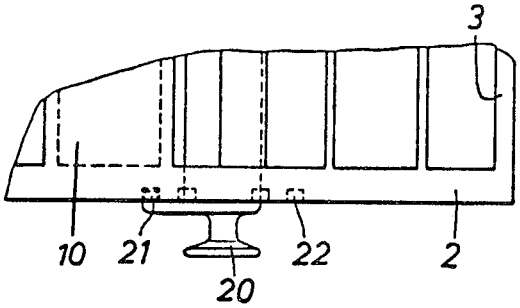
FIG. 7 - a top view on the right hand part of the device depicted in FIG. 5.
Figure 5:
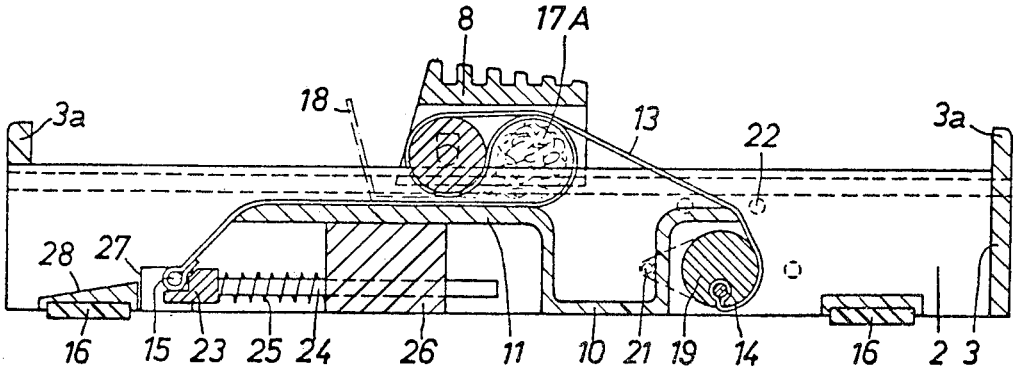
FIG. 5 - a longitudinal section through another feature of the invention

The examples in FIGS. 5 through 7 show an especially advantageous further refinement of the invention. Pin 14 securing belt 13 on the right-hand side is eccentrically inserted into shaft 19 which is stored in side walls 2 of basic structure 1 and which is adjustable by means of adjusting knob 20, located outside the basic structure 1 to certain different angles. Adjusting knob 20 has a dog 21 which can be brought into meshing relationship with recesses 22 in side walls 2 of basic structure 1.

By pulling out and twisting of adjusting knob 20, the right end of belt 13 is wound around shaft 19 and thereby shortens the length of belt 13. This decreases the diameter of tobacco cylinder 17A and inherently the diameter of the cigarette to be rolled, and, therefore, permits selection of the cigarette diameter desired.

According to another advantageous refinement of the invention, securing pin 15, depicted to the left in the drawing, is positioned in head 23 of rod 24. This rod is resiliently displacable against the force of a spring 25 which is braced at both head 23 and at guide 26 for rod 24. Normally, spring 25 pushes rod 24 to the left, so that pin 15, at edge 27, abuts a recess located in the basic structure 1, as is shown in FIG. 6. In the event that the diameter selected by the adjusting knob 20 causes too much tobacco to be inserted into tobacco cylinder 17A, a too tightly rolled cigarette with little or no draw would result without the benefit of the above design. Thus, the tension exercised onto belt 13 permits securing pin 15 to displace rod 24 against the force of spring 25 to the right. In this manner, tobacco cylinder 17A is enlarged, and it is avoided that the tobacco contained therein is too tightly compacted.

The device for automatic adjustment of tension onto belt 13 is also successfully applicable onto the configuration depicted in FIG. 1.

What is claimed

1. Device for rolling of cigarettes with a flat basic structure open on the top, in which there is disposed a belt moving around a cylinder, characterized in that the cylinder is rotatably arranged in a slidable member alongside an upper edge of the basic structure, and that transverse to the direction of movement, under the belt, there is a recess, which at its upper edge, terminates into flat tables, and wherein the belt is connected to a shaft rotatably mounted in the basic structure for adjusting the length of the belt and thereby adjusting the diameter of cigarettes rolled by the device.

2. Cigarette device according to claims 1, or 7 characterized in that the slidable member has a tongue which is slidably anchored in a groove in a side wall of the basic structure.

3. Cigarette device according to claim 1, characterized in that lockable adjusting means are provided for firmly locking the shaft at a certain angular position.

4. Cigarette device according to claim 1, characterized in that the belt is connected to at least one mounting pin which is displacable against the force of a spring.

5. A device for rolling of cigarettes with a flat basic structure open on top, in which there is disposed a belt moving around a cylinder, characterized in that the cylinder is rotatably arranged in a slidable member alongside an upper edge of the basic structure, and that transverse to the direction of movement, under the belt, there is a recess, which at its upper edge, terminates into flat tables, and wherein the belt is connected to at least one mounting pin which is displacable against the force of a spring.

6. Cigarette device according to claims 4 or 5 characterized in that the mounting pin is held by a rod which is mounted in the basic structure and horizontally displacable against the force of said spring.

* * * * *